United States Patent [19]

Spicer

[11] Patent Number: 4,594,754

[45] Date of Patent: Jun. 17, 1986

[54] CLAMP FOR HOLDING SHEET ARTICLES

[75] Inventor: Victor R. Spicer, Auckland, New Zealand

[73] Assignee: Planhorse International (NZ) Limited, Auckland, New Zealand

[21] Appl. No.: 619,179

[22] Filed: Jun. 11, 1984

[30] Foreign Application Priority Data

Jun. 13, 1983 [NZ] New Zealand ..... 204550

[51] Int. Cl.[4] ..... B42F 1/00

[52] U.S. Cl. ..... 24/536; 24/502; 24/67.1; 211/48

[58] Field of Search ..... 24/67 R, 67.1, 67.3, 24/67.5, 489, 500, 523, 527, 536, 502, 513, 514, 459; 211/45, 46, 48

[56] References Cited

U.S. PATENT DOCUMENTS

| | | | |
|---|---|---|---|
| 855,464 | 6/1907 | Leonard | 211/48 X |
| 2,869,210 | 1/1959 | Schneider | 24/502 |
| 3,069,737 | 12/1962 | Schneider et al. | 24/67.1 |
| 3,221,892 | 12/1965 | Morcheles et al. | 248/221.3 X |
| 3,364,528 | 1/1968 | Fletcher | 24/67.1 |
| 3,896,526 | 7/1975 | Joiner | 24/67.1 |

FOREIGN PATENT DOCUMENTS

| | | | |
|---|---|---|---|
| 671574 | 10/1963 | Canada | 211/48 |
| 16519 | 12/1980 | New Zealand . | |
| 2017586 | 10/1979 | United Kingdom | 24/502 |

*Primary Examiner*—William E. Lyddane
*Assistant Examiner*—Laurie K. Cranmer
*Attorney, Agent, or Firm*—Holman & Stern

[57] ABSTRACT

An improved clamp apparatus for storing sheets, for example of paper or foil, including especially maps and drawings, the sheets being neither rolled nor folded so that they can be readily inspected, and a considerable number of sheets can be stored without interfering with each other. The sheets are held from above from any convenient rail, by being inserted, singly or multiply in a clamp that may be comparable in length with the sheet the pressure of the clamp being adjusted gradually by means of wing nuts on self locking bolts and being biased by leaf springs.

2 Claims, 4 Drawing Figures

CLAMP FOR HOLDING SHEET ARTICLES

BACKGROUND OF THE INVENTION

1. Field of the Invention

This invention relates to an improved clamp. In particular, it relates to a clamp for holding one or more sheet articles, such as drawings or maps.

2. Description of the Prior Art

Large sheet articles of paper, thin cardboard or plastics material such as maps, tracings, charts, prints or plans cannot easily be stored or mounted for reference. It is with this difficulty in mind that the present invention was devised. Known methods of storing large sheet articles commonly involve rolling the sheets, punching holes in the articles, or permanently affixing tabs or the like to the articles, which is often unsatisfactory as the articles cannot be folded and must be kept flat and in good condition.

New Zealand Design Pat. No. 16,519, issued Dec. 12, 1980 to Planhorse International Limited of New Zealand, disclosed a clamp for holding one or more sheet articles comprising a pair of jaws, each jaw having an elongate gripping part and an elongate base part, one of said base parts being pivotable about the other base part, a closing means adapted to bring together, in use, the gripping parts in order to hold one or more sheet articles between the gripping parts by causing the pivotable base part to pivot about the other base part. This clap, however, had no biasing means to enable the gripping parts to be self-opening. Also, the adjustment bolt was not self locking.

SUMMARY OF THE INVENTION

The present invention consists in a number of significant improvements on our basic clamp, the most important of which comprises biasing means biased to urge the gripping parts apart.

An L-shaped leaf spring which provides a biasing pressure against the opposing legs of the clamp is disclosed. Also disclosed in an improved assembly/adjustment bolt.

One advantageous feature of the spring-biased clamp combination of the present invention is that the use of a thin flat leaf spring to bias the gripping legs of the clamp allows thin sheets of paper, which may number anywhere between one and one hundred sheets, to be inserted between the gripping legs without fouling their edges against the biasing means. In other words, the thin spring of the present invention presents no obstacle to the insertion of paper into the clamp.

Another advantage of the present invention is that the spring is held in place by the same bolt which holds the two separate elongate jaws of the clamp. Attachment of the spring to the lower jaw by means of the bolt results in the bolt itself being tensioned against the lower jaw. This facilitates assembly by keeping the bolt from falling out of the lower jaw when the upper jaw is being put in place. Furthermore, should the wing nut, which holds the clamp jaws together and provides tensioning force, fall out in use, the bolt will not dislodge and become lost within the interior of the clamp mechanism.

Another feature of the present invention is that the biasing spring is designed to be capable of retrofitting to existing prior art paper sheet clamps. A spring is disclosed which fits between the upper and lower bases of the two jaws of existing clamps and provides its outward biasing force by abutting against the inner wall of the gripping leg of the upper jaw. Furthermore, because the spring is adapted to be secured by the existing assembly bolts, it may be retrofitted to prior art sheet clamps while allowing such clamps to receive final assembly at only two places. The jaws of the clamp are assembled by holding them together, along with the springs, by means of the two assembly bolts. As discussed in detail below, the assembly bolts also serve to tension and adjust the clamping action of the clamp when in use.

Yet another feature of the present invention is an improved head for the assembly bolt. In prior art paper sheet clamps of the type improved by the instant invention, the assembly bolts were round headed and the heads were so small as to not contact the projecting flange of the lower base of the clamp. For this reason, the prior art bolts tended to rotate along with the wing nut when a user attempted to tighten the wing nut.

The improved head of the bolt of the instant invention has at least one flat surface on its otherwise circular circumference. Furthermore, the head is enlarged so that when used in combination with the lower jaw of the clamp the flat surface of the head abuts against a flange on the base, preventing the bolt from turning when the wing nut is tightened.

Yet another feature of the instant invention is a flangeless stopper which allows the clamp to be removed from a support fitment by a tilting action, the clamp being supported on the fitment by only one flanged member.

DETAILED DESCRIPTION OF THE PREFERRED EMBODIMENT

The clamp comprises a pair of elongate jaws 1,1*a*. Each jaw has an elongate base 2,2*a* and an elongate gripping leg 3,3*a*. The jaws 1,1*a* are typically made of strips of extruded anodized aluminum. The jaws may be of different lengths, depending on the application. 82.5 cm would be a typical length.

Figure 2:
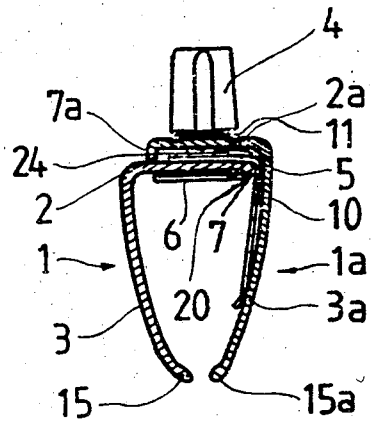
FIG. 2 is a cross-sectional end view of the clamp taken along lines z—z of FIG. 1, on a large scale and somewhat simplified.

One of the bases is pivotable about the other base. In FIG. 2, the upper base 2*a* is pivotable about the lower base 2.

A closing means is provided which is adapted to bring together in use the gripping legs 3,3*a*to hold one or more sheet articles (not illustrated) between the gripping legs. The preferred closing means is a nut 4 which is provided with wings for ease of turning by hand. The nut 4 is threaded on a bolt 5 which has a head 6 and which passes through circular holes in the bases 2 and 2*a*. The hole in the pivotable upper base 2*a* should be larger than the diameter of the bolt 5 to allow for pivotal movement of that base about the bolt 5.

Figure 3:
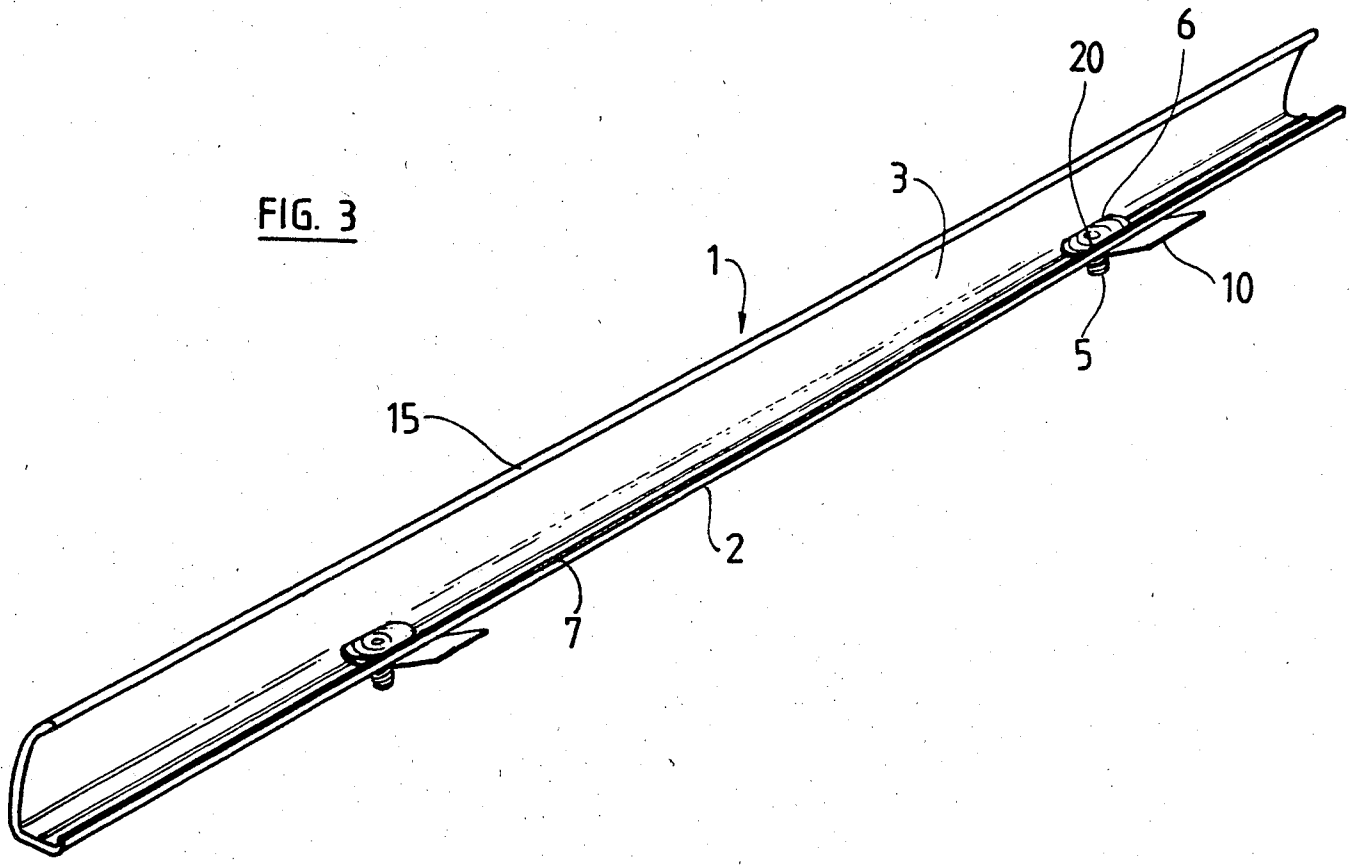
FIG. 3 is a perspective view of the lower jaw from below.

The head 6 of the bolt 5 abuts a portion of the lower base 2 of jaw 1 so that the bolt 5 will not turn when the nut 4 is tightened. One edge of the head 6 can be flattened as shown in FIG. 3 to turning resist movement. In FIG. 2 the lower base 2 is shown provided with a flange 7 against which the bolt head 6 abuts.

The clamp is provided with biasing means biased to urge the gripping legs apart. The biasing means is preferably a steel leaf spring 10 which is held in place by the bolt 5, which passes through a hole 23 in the spring 10. A clip 24, such as a circlip or gripping washer, for example may also be included between the leaf spring 10 and upper base 2*a* in engaging relationship with the bolt to hold the bolt 5 and the spring 10 onto the lower base 2, particularly when nut 4 is very loose or removed. The spring 10 acts against the upper jaw 1*a* so as to urge the gripping leg 3*a* away from the gripping leg 3. Preferably a biasing means is provided for each closing means.

Figure 1:
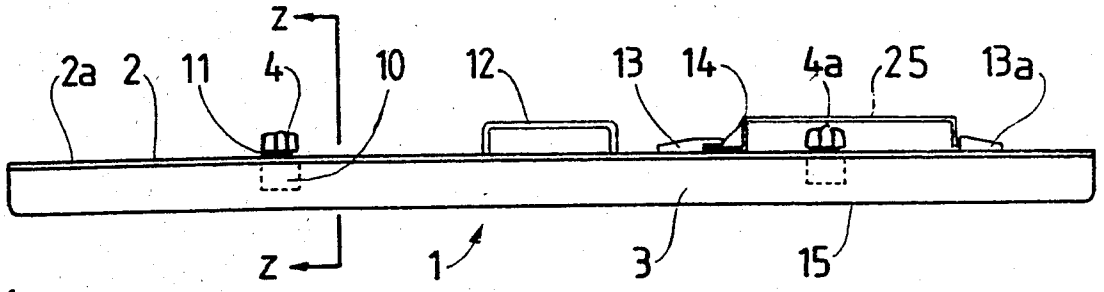
FIG. 1 is a side elevational view of the clamp.

A handle 12 is attached at or near the center of the upper base 2*a*. This enables the clamp and retained sheets to be lifted and moved easily. In FIG. 1 the handle 12 may be formed by of a bent steel rod which is attached to the upper base 2*a* by screwing; but the handle may be constructed and attached in other ways.

Attachment means 13,13*a* are also affixed to the upper base part 2*a*. These are typically formed of plastics material and are rivetted onto the upper base 2*a*. They are designed to enable the clamp to be attached to a fitment 25, for instance on a rack, trolley or stand (not illustrated) on which a number of the clamps may be mounted. The attachment means 13 shown has an elevated projecting flange 14 which engages with a flange or flanges on the fitment and holds the clamp in place. Alternative forms of attachment means may be used, for instance, hooks or eyes. Stopper 13*a* prevents the clamp from slipping forward when attached to the fitment. This stopper could be a knob of cylindrical or other flangeless shape. To remove the clamp from the fitment, the clamp is tilted down at the leading end so the stopper drops underneath the rear of the fitment, and the clamp can be removed by moving in a reverse direction.

As can be seen from FIG. 2 each jaw 1,1*a* in cross-section has a flange 7,7*a* depending from the base 2,2*a*. The gripping legs 3,3*a* also depend from the base, the gripping legs being substantially at right angles to the bases adjacent the bases, and inclining inwardly so that the far ends 15,15*a* of the gripping legs 3,3*a* are substantially underneath the middle of their respective bases 2,2*a*. The depending gripping leg 3*a* of upper jaw 1*a* is longer than the gripping leg 3 of lower jaw 1. Base 2*a* substantially overlaps base 2 and flange 7*a* contacts base 2, so that the far gripping ends 15 and 15*a* of the jaws can meet.

In use, the closing means are operated using hand pressure by tightening the nuts 4,4*a* causing the pivotable upper base 2*a* to pivot about lower base 2; flange 7 *a* forming the pivot point. This operation is eased by nylon washer 11. The downward pressure provided by the tightening of nut 4 thus causes pivoting leg 3*a* to approach and close on gripping leg 3 at far ends 15,15*a*. Hand tightening nuts 4,4*a* provides sufficient pressure between gripping legs 3,3*a* at their far ends 15,15*a* to hold one or more sheet articles between the jaws, so that the articles will not fall out under their own weight.

To release the articles between the jaws, nut 4 is loosened, and the biasing means provided by the spring 10, which spring was deformed by gripping part 3*a* as jaw 1*a* closed on jaw 1, forces the jaws apart.

It has been found expedient to increaase the depth of flange 7 over prior art flanges to provide a more satisfactory locking edge for head 6 of bolt 5. The bolt 5 has been especially designed with a head 6 which has a long flat edge 20 to lock against flange 7. This prevents the bolt from rotating when the wing nut 4 is tightened.

An especially designed leaf spring 10 has been made. It is to be secured to the bolt 5 where it penetrates the inner extrusion lower base 2. The leaf spring 10 fits snugly against the inner extrusion wall of leg 3*a* thus preventing snagging of paper sheets within the clamp. The leaf spring 10 causes the pivoting upper jaw 1*a* to self-open as wing nut pressure is released. This is an important aspect when one wants to remove sheets from within clamps singly or multiply. In such cases, since one hand is needed to hold the sheets, only one hand is available to loosen the nut 4 and none is available to bias open the jaws 1,1*a*. The spring 10 operates to provide this bias. The spring also contributes to overall positive operation of the clamp when tightening. The distal end of spring 10 may be bent or rounded in order that it slide freely against the inner surface of gripping leg 3*a*.

The leaf spring 10 is also designed to lock the bolt 5 in position so that the flat edge 20 of bolt head 6 abuts the extrusion flange 7. This facilitates assembly—otherwise the bolt 5 tends to drop out.

Figure 4:
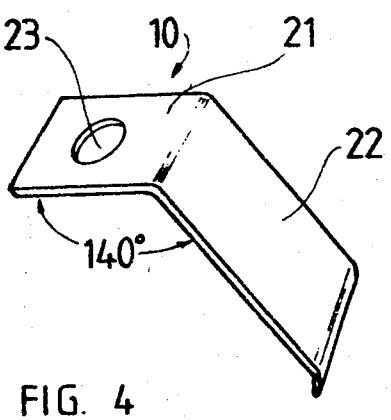
FIG. 4 is a perspective view of the spring on a larger scale.

The leaf spring 10, shown in FIG. 4, consists of a planar upper leaf 21 from which depends a planar lower leaf 22. The lower leaf 22 is bent at an angle of about 140° from the upper leaf 21 when the spring 10 is in its resting state of non-compression. As shown in FIG. 2, the spring 10 may be compressed in use to an included angle of about 90° without undergoing permanent deformation. The spring 10 is preferably made of 30 gauge spring steel.

A specially designed wing nut 4,4*a* is used. This provides a comfortable finger tightening shape so that maximum purchase can be applied to tighten the clamp jaws 1,1*a* fully without special tools.

The above broadly describes the preferred embodiment of the present invention and its method of use, and gives some alternatives. However, many modifications can be made without departing from the scope of the invention as claimed.

For example, the flange 7*a* may be attached to jaw 1, and the steel spring 10 may be replaced by a coiled steel spring or an elastic substance. Furthermore, the nut 4 may be replaced by a toggle or cam arrangement connected to a lever or handle to provide the required downward force.

I claim:

1. In a clamp for holding one or more sheet articles of the type having a pair of jaws, each jaw in cross-section having a substantially flat base, a flange depending from the base at one end and a gripping leg depending from the other end, the gripping leg being substantially at right angles to the base where it attaches to the base and the gripping leg inclined inwardly to an outer end so that the outer end is substantially underneath the middle of the base with the gripping legs converging together, one of the bases being mounted uppermost above and pivotable about the other lowermost base, a hole in the uppermost base and a hole in the lowermost base, a bolt passing through said holes and a nut threaded on said bolt adapted to bring the gripping legs together when tightened in use by rocking movement of one of the bases, the improvement comprising: the uppermost base is rocked about its flange; the head of the bolt has a flat portion which lies adjacent to said flange of the lowermost base restraining the bolt from turning as the nut is turned in use; and a biasing leaf spring to urge the gripping legs apart, said leaf spring being "L"-shaped and comprising upper and lower planar leaves extending with respect to each other to provide an obtuse included angle therebetween when not compressed, said lower planar leaf bearing against and lying closely adjacent the inner wall of the gripping leg associated with the uppermost base, said upper planar leaf being sandwiched between the uppermost and lowermost bases, and a hole in said upper planar leaf through which said bolt passes, the angle between the leaves of the spring being such that the spring biases the gripping legs to an open position suitable for insertion of sheet articles between them when the nut is loosened on the bolt.

2. The clamp of claim 1 and further comprising a clip located between the planar upper leaf of the spring and the uppermost base operatively engaging said bolt for holding said bolt and spring onto the lowermost base.

* * * * *